US010427435B2

(12) United States Patent
Singla et al.

(10) Patent No.: US 10,427,435 B2
(45) Date of Patent: Oct. 1, 2019

(54) PRINTING INDICIA INDICATING AN INTENDED LOCATION OF A FOLD LINE

(71) Applicant: Hewlett-Packard Development Company, L.P., Houston, TX (US)

(72) Inventors: Joan Singla, Sant Cugat del Valles (ES); Carlos Ciuraneta Sanchez, Sant Cugat del Valles (ES); Francesc Roure Pastor, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/760,750

(22) PCT Filed: Jan. 29, 2016

(86) PCT No.: PCT/EP2016/051985
§ 371 (c)(1),
(2) Date: Mar. 16, 2018

(87) PCT Pub. No.: WO2017/129263
PCT Pub. Date: Aug. 3, 2017

(65) Prior Publication Data

US 2018/0250971 A1 Sep. 6, 2018

(51) Int. Cl.
*B65H 45/12* (2006.01)
*B41J 29/393* (2006.01)
(Continued)

(52) U.S. Cl.
CPC ..... *B41J 29/393* (2013.01); *B65H 45/12* (2013.01); *B65H 45/14* (2013.01); *B65H 45/18* (2013.01);
(Continued)

(58) Field of Classification Search
CPC ..... B65H 45/12; B65H 2220/01; B65H 2511/20; B65H 2511/512;
(Continued)

(56) References Cited

U.S. PATENT DOCUMENTS 4,176,833 A 12/1979 Heimlicher
4,352,671 A 10/1982 Petersen
(Continued)

FOREIGN PATENT DOCUMENTS

CN 203558639 4/2014
JP 2005132630 9/2004
JP 2013067486 10/2014

OTHER PUBLICATIONS

Machine translation of JP 2013-067486; https://www4.j-platpat.inpit.go.jp/cgi-bin/tran_web_cgi_ejje?u=http://www4.j-platpat.inpit.go.jp/eng/translation/201810030048265109279459024589074 15DE9FB4A8F284CA0842314575CE4DFE (Year: 2013).*
(Continued)

*Primary Examiner* — Leslie A Nicholson, III
(74) *Attorney, Agent, or Firm* — HP Inc. Patent Department

(57) ABSTRACT

In an example, a print apparatus includes a controller and a printing unit. The controller may control the printing unit to print a media sheet with at least one indicia indicating an intended location of a fold line, wherein the media sheet is to be folded along the fold line. The controller may be to control the printing unit to print the at least one indicia to provide an offset gauge such that, when the media sheet is folded along a formed fold line, the indicia provides an indication of an offset between the intended location of the fold line and the formed fold line.

11 Claims, 4 Drawing Sheets

(51) Int. Cl.
*B65H 45/14* (2006.01)
*B65H 45/18* (2006.01)

(52) U.S. Cl.
CPC ... *B41J 2029/3935* (2013.01); *B65H 2220/01* (2013.01); *B65H 2301/5111* (2013.01); *B65H 2511/20* (2013.01); *B65H 2511/512* (2013.01); *B65H 2511/522* (2013.01); *B65H 2557/61* (2013.01); *B65H 2701/124* (2013.01)

(58) Field of Classification Search
CPC ..... B65H 2511/522; B65H 2701/124; B65H 2701/1241; B65H 2701/12411
USPC ..... 270/1.01, 4, 45, 52.02; 493/405
See application file for complete search history.

(56) References Cited

U.S. PATENT DOCUMENTS 4,578,052 A * 3/1986 Engel ..... G01B 7/02 493/11
4,775,169 A * 10/1988 Barth ..... B42D 15/00 283/115
6,499,402 B1 12/2002 Sikes et al.
6,935,998 B2 * 8/2005 Silvestre ..... B65H 29/66 493/10
7,087,006 B2 * 8/2006 Manico ..... B42F 5/005 493/397
7,220,223 B2 5/2007 Erdt et al.
2005/0090373 A1 * 4/2005 Schmid ..... B65H 45/12 493/11
2008/0277858 A1 11/2008 Shichijo et al.
2013/0203579 A1 8/2013 Vermunt
2013/0293902 A1 * 11/2013 Seto ..... H04N 1/3873 358/1.5
2014/0224018 A1 8/2014 Whitesides et al.

OTHER PUBLICATIONS

Webpage. How Does a Paper Folding Machine Work?, Jan. 15, 2013, <http://www.officezone.com/office-products-insight/tag/paper-folders/>.

* cited by examiner

PRINTING INDICIA INDICATING AN INTENDED LOCATION OF A FOLD LINE

BACKGROUND

Folding apparatus may be used to form folds in a medium such as paper, card or plastic sheeting, for example to form structures or folded articles such as leaflets and the like. In some examples, folding apparatus use plates and/or rollers to form a fold, for example pressing down on a loop formed within a medium.

BRIEF DESCRIPTION OF DRAWINGS

Non-limiting examples will now be described, with reference to the accompanying drawings, in which.

DETAILED DESCRIPTION

Figure 1:
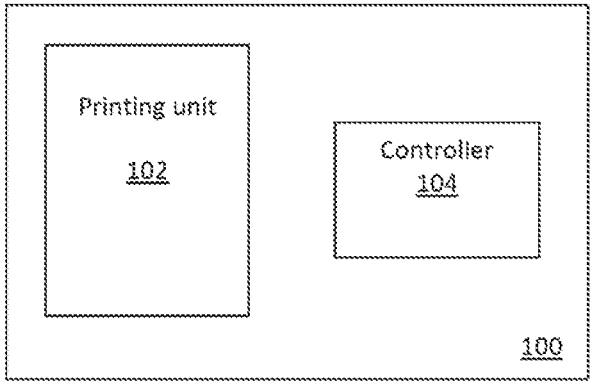
FIG. 1 is a simplified schematic of an example print apparatus.

FIG. 1 is a schematic representation of a print apparatus 100 comprising a printing unit 102 and a controller 104. The printing unit 102 may comprise a printing unit 102 capable of printing on a media sheet. For example, the printing unit 102 may comprise an ink-jet printing unit, a laser printing unit, a thermal printing unit, or the like. The controller 104 may control the printing unit 102 to print at least one indicia indicating an intended location of a fold line, wherein the media sheet is to be folded along the fold line. The indicia provides an offset gauge such that, when the media sheet is folded along a formed fold line, the indicia provides an indication of an offset between the intended location of the fold line and the formed fold line. It is noted that in at least some of the examples herein, the term "unit" refers to a hardware component of the apparatus it is associated with. The controller 104 may determine the intended location of the fold line, for example from data representing a design to be printed by the printing unit and which is to be folded along at least one fold line. Such a design may for example comprise an image and an indication of a location of at least one fold line.

In some examples, the indicia is a visible mark, i.e. is printed in visible ink or some other colorant, in some examples, the controller 104 is to print at least one indicia to have a predetermined spatial relationship with, for example to overlie the intended location of, the fold line.

Figure 2:
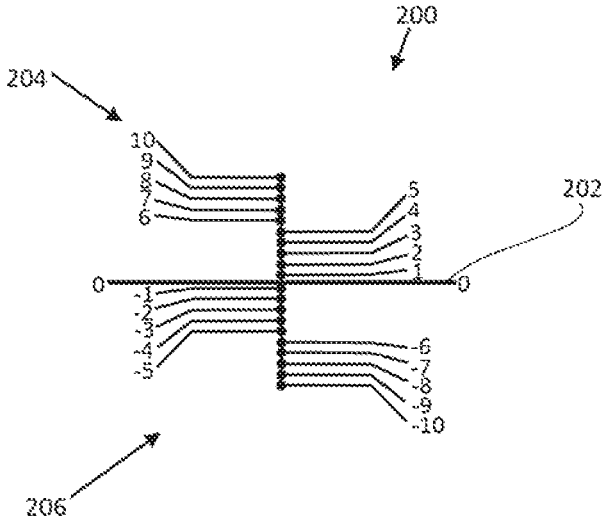
FIG. 2 is an example of an indicia which may be printed by the print apparatus.

An example of an indicia is shown in FIG. 2. In this example, the indicia 200 provides an offset gauge such that, when, the media sheet is, folded along a formed fold line, the indicia 200 provides an indication of any offset between the intended location of the fold line and the formed fold line. In particular, in this example, the indicia 200 comprises a '0' line 202 which is printed under the control of the controller 104 so as to coincide with the intended location of the fold line. Such a position may for example be defined as an offset and/or angle to an edge or some other reference point on a media sheet. The indicia 200 further comprises a plurality of offset markers 204, 206, which provide a scale indicating the degree of any offset. A first set of offset markers 204 appears above the '0' line 202 and indicates a positive offset (i.e. from a reference such as the edge of a media sheet, these markers mark locations which are further from that reference than the intended location of the fold line). A second set of offset markers 204 appears below the '0' line 202 in FIG. 2 and indicates a negative offset (i.e. from a reference such as the edge of a media sheet, these mark locations which are closer to that reference than the intended location of the fold line). The offset markers 204, 206 in this examples are labelled with distance measurements (i.e., the scale comprises printed graduations). In some examples, these distance measurements may be in a standard measurement unit, for example millimeters or the like. In some examples, the unit used may relate to a calibration unit of a folding apparatus. In some examples, an offset between the intended location of the fold line and a formed fold line is determinable from the position of the formed fold line on the scale.

It may be noted that the indicia 200 in this example contains no words, just graphics and numbers and thus can be used world-wide without any need of translation.

Although the indicia 200 shown in FIG. 2 has a particular form, other indicia are possible. For example, an indicia may comprise spatially separated points, at least some of which may be joined by a fold line formed in the intended position. Moreover, in other examples, the markings of the indicia may not be intended to be placed along the fold line, which may for example be marked as a void, or be indicated by the tip of at least one marker shape such as arrows or the like. An indicia may comprise at least one longitudinal element (such as the '0' line 202 and the parallel portions of the offset markers 204, 206), which is intended to lie along or parallel to at least part of a fold line. In some examples, a plurality of indicia may be associated with the intended location of a single fold line.

In methods, of forming fold lines in a media sheet using folding apparatus, the intended location of the fold lines may be determined in advance. In some examples folding apparatus is associated with, or comprises a part of print apparatus 100 (or the print apparatus 100 may be associated with or comprise folding apparatus). In some examples, the location of a fold is specified along with the specification of a printed design. Folding apparatus can suffer from misalignment. This may be for example a physical misalignment between a printing unit 102 and a folding apparatus. For example, respective conveying mechanism (for example, at least one endless belt or rollers or the like) of a printing unit 102 and a folding apparatus may not be correctly aligned. In other examples, the internal components of a folding apparatus may shift or become misaligned. This can result in a discrepancy between the intended location of a fold line and the actual placement of that line by the folding apparatus.

It may be the case that folding of printed material occurs in line with the printing process itself. In such a case, such a discrepancy can result in a poor quality or even unusable folded article, in the event of such a discrepancy, it may be possible to reconfigure at least part of the folding apparatus and/or its relationship to a printing unit 102. Use of a printed indicia, for example as described herein, may provide a visual indication of a discrepancy. In some examples, a degree of offset may be read directly by a user (for example, a service engineer or the like). In other examples, a degree of offset may be reviewed using image capture and image processing methods. For example, it may be determined from observation if an actual fold line is not aligned with a component of the indicia (in the example of FIG. 2, the '0' line 202). A gauge providing an indication of a degree of discrepancy (in the example of FIG. 2, the actual fold may be formed along one of the offset markers 204, 206) may in turn assist in realignment, and/or recalibration or the like. In examples where a fold is formed, it may be that, in a given view of the media sheet, part of an indicia may remain visible while another part is obscured. In some examples, the indicia may be designed such that a partial view provides an indication of the offset. Such an arrangement may be compared to a point marker, for instance: when such a marker is not visible, this may be in an indication of a mis-placement of a fold line, but the degree of displacement and/or the type of displacement (for example, lateral or angular) may not be apparent.

In some examples, the printed indicia may be relatively less complex, or consume less by way of printing resources, than an image which it is intended that a folded printed article bears. To consider just one example, the print apparatus 100 may be intended for use in printing a leaflet or map which may for example comprises a number of colors, may be printed to a high quality and may for example comprise a glossy finishing overcoat. Such an image may be relatively time consuming and costly to produce, and, if a fold line is misplaced, the leaflet or map may be discarded. Therefore, the indicia 200 may be printed as a calibration stage (which may in some examples be iterated until any offset is resolved), and any misalignment corrected before the intended image is printed. This may mean that there are no poorly folded articles produced, and therefore printing resources may be conserved. Such calibration may be carried out in advance of, or during (for example, periodically during), a print run.

In other examples, an indicia may be printed with an image. It may be acceptable to display a visible indicia along with the image. In some examples, however, indicia may be invisible to the human eye, but detectable under, for example ultraviolet light. An image of such indicia may be acquired by a user or by an image capture device, such as a camera, the media sheet being for example illuminated by an appropriate light source, and used for on-going recalibration of the folding apparatus without disrupting a visual impression produced by any other image which is intended to be visible to the human eye.

Figure 3A:
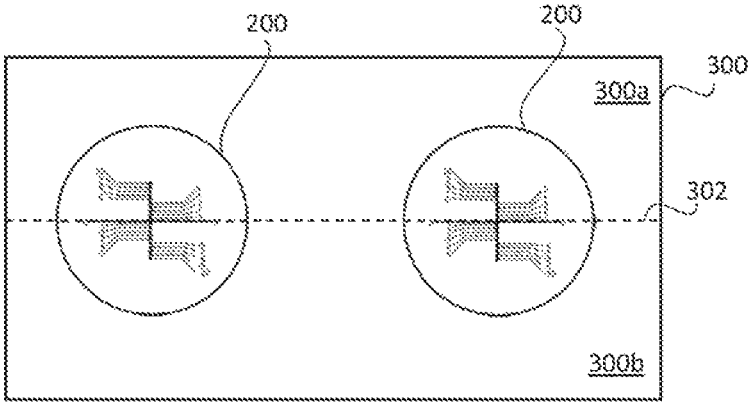
FIGS. 3*a*-3*c* are examples of media sheets bearing indicia and comprising fold lines.
Figure 3B:
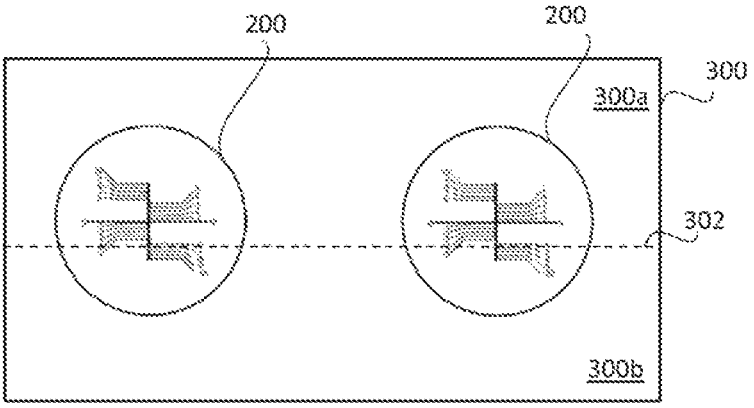
Figure 3C:
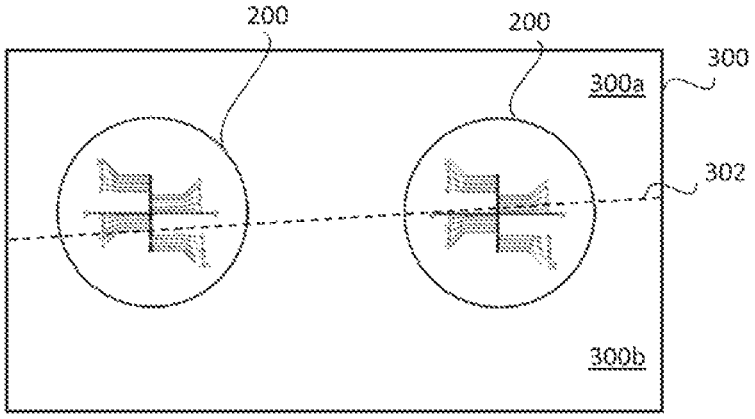

FIGS. 3*a*-3*c* show a sheet of media 300 comprising a formed fold line 302 (shown as a dotted line) and two printed indicia 200. In this example, the indicia 200 are provided within a printed circle. This increases their overall size and may mean that portion of the indicia 200 is visible even if a formed fold line is beyond the limits of the scale. The fold line 302 divides the sheet 300 into two portions 300*a*, 300*b* (which are rectangular for FIGS. 3*a* and 3*b*, and trapezoid in shape in the example of FIG. 3*c*). It will be appreciated that, once folded, one of these portions 300*a*, 300*b* may be obscured depending on the viewing angle. In each example, the '0' line of the indicia 200 is printed so as to lie along the intended location of the fold line. In other examples, there may be more indicia 200 associated with a fold line, or fewer.

In the example of FIG. 3*a*, the fold line 302 coincides with the '0' line of the indicia 200, indicating that the fold line has formed in the intended location.

FIG. 3*b* shows an example in which the fold line 302 is offset, but substantially parallel to, the '0' line 202 of the indicia 200. This indicates, a lateral offset between the intended and actual location of the fold line 302. In the example of the figure, the fold line 302 is aligned with the −7 offset marker. This may for example indicate that the fold line is seven units (for example, seven millimeters) closer to a reference point such as a page edge than is intended. In some examples, this may indicate that, in order to correct the misplacement, an apparatus used to form the fold may be adjusted by seven units (for example, seven notches on a positioning dial or the like).

FIG. 3*c* shows an example in which the fold line 302 is at an angle to the '0' line of the indicia 200. In this example, there is more than one indicia associated a fold line. The degree of angular offset can be determined by the difference between the offset markers intersected by the fold line 302. In particular, in the example of FIG. 3*c*, the actual fold line 302 intersects a first indicia 200 at the −5 offset marker and a second indicia 200 at a +2 offset marker. If the distance between the indicia 200 is known, this can be used to derive an angular offset. The angular offset may be quantified as an absolute value (for example, a skew could be determined to be, for example, 3 mm (or any other number of any defined unit of measurement) between points a given distance apart, which may be the distance between the indicia 200) or a relative value (for example 3 mm per meter (or any other number of any defined unit of measurement)).

Thus it can be seen that, in this example, each indicia 200 provides an offset gauge providing an indication a lateral offset, and a plurality of the indicia 200 can be used to provide an indication of an angular offset. In this example, either a crease marking the fold line 302 through the indicia 200 or the portions of an indicia 200 visible on one side of the fold line 302 can be used to indicate a degree of recalibration to be carried out. Although more than one indicia 200 is used to determine an offset in this example, it may be that an indicia which provides an indication of an angular offset is provided (for example, comprising linear elements extending at different angles, wherein the offset may be determined according to which linear element lies parallel to a formed fold line).

Figure 4:
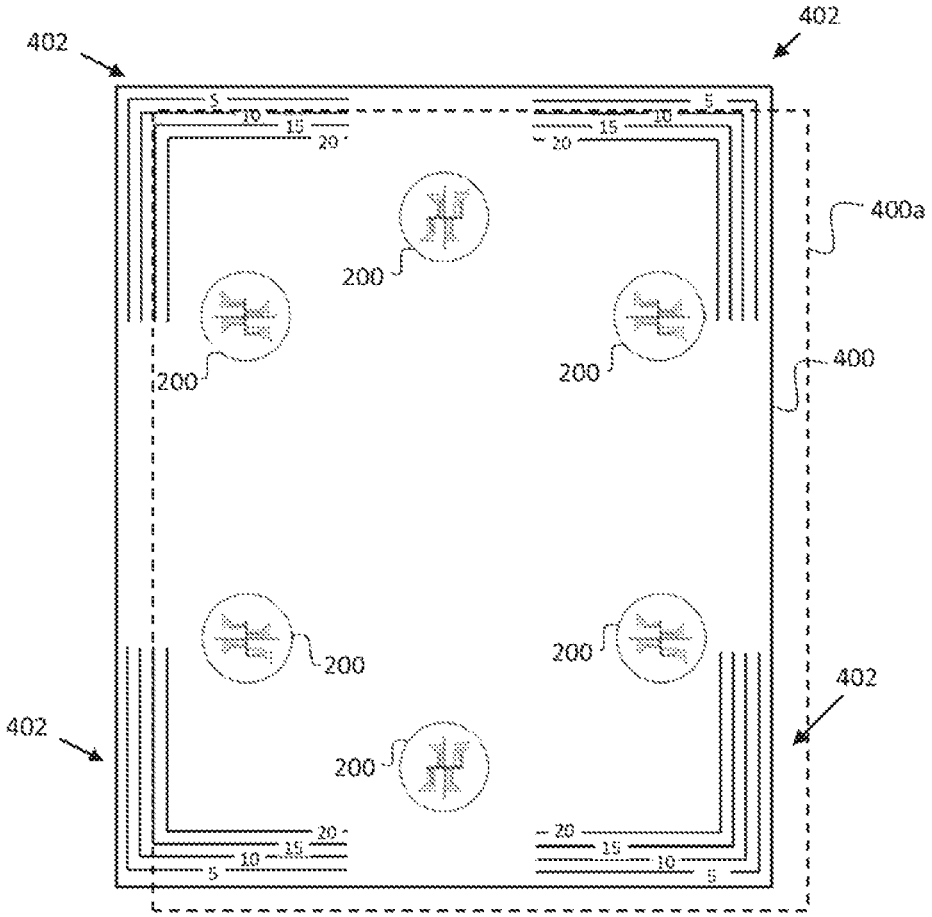
FIG. 4 is an example of a media sheet bearing indicia and registration marks.

FIG. 4 shows an example of a printed media sheet 400. In this example, the media sheet 400 is to be folded twice along its length and once along its width. Two indicia 200 are printed to overlie spaced locations along each intended location of the fold line (although in other examples, there may be one indicia, or more than two indicia). In this example, the printed media sheet 400 has been printed by a print apparatus 100 in which the controller 104 controls the printing unit 102 to print at least one registration mark 402 to indicate a registration or mis-registration of the printing unit 102 and the media sheet 400. In particular, in this example, the controller 104 controls the printing unit 102 to print four registration marks 402, one in each corner of the sheet 400. In this example, the marks 402 are arranged such that, in the event of mis-registration between the printing unit 102 and the media sheet 400, at least one of the marks 402 will be at least partially outside the intended print area. In some examples, the intended print area may comprise the entire printable region of a sheet 400 (for example, the region of the sheet which the print unit 102 may apply a colorant such as an ink or toner). The controller 104 may determine the location in which to print the registration marks, for example from data indicating the size and shape of the media sheet.

The registration marks 402 may provide a registration gauge providing an indication of an amount of a mis-registration. In this example, the registration marks 402 provide a registration offset gauge such that a portion of registration mark 402 which is printed within the intended print area provides an indication of the degree of mis-registration between the printing unit 102 and the media sheet 400. In particular, the registration marks 402 provide a plurality of corner markings, each associated with a depth. If a registration mark 402 is partially missing, this is an indication of a mis-registration, and the outmost marking which still appears is indicative of the degree of mis-registration. In some examples, the registration marks 402 may be associated with a standard measurement unit, for example millimeters or the like. In some examples, the unit used in relation to the markings may relate to a calibration unit of the print apparatus 100.

An example of a misaligned sheet is represented with a dotted outline 400*a*. In this example, portions of the upper two and the lower left registration marks 402 fall outside the page so would not be printed. The registration marks 402 which are cut off on the top edge are cut off at the '10' marker, whereas the registration marks 402 which are cut off on left top edge are cut off at the '15' marker. This indicates a vertical misalignment of 10 units and a horizontal misalignment of 15 units, which may for example be corrected by recalibrating the print apparatus 100.

The difference between the retained portions of two registration marks 402 may provide an indication of skew, for example quantified by a unit length, for example, the skew or angular offset may be quantified as x mm per meter, or more generally to an offset difference edge to edge per given distance. In other examples, the registration marks 402 may comprise angularly extending longitudinal portions, which may provide an indication of skew.

As in this example registration marks are provided in each corner, a mis-registration in any direction may be noted and quantified using the numbers printed in association with the longitudinal portions of the marks 402. In other examples, the marks 402 may have different forms, for example having any form which may be readily determined by a user or by image analysis to have a section thereof missing. In some examples, intermediate marker lines may be provided to provide a more accurate indication of mis-registration.

While determining a print misalignment may be used purely to detect misalignment between the printing unit 102 and the media sheet 400, by printing a registration mark 402 at the same time as printing an indicia 200 associated with an intended location of the fold line, it can be determined whether an offset between the intended location of the fold line and the actual location of the fold line is due to a print misalignment or a folding apparatus misalignment. Further, printing both indicia and registration marks on the same sheet may allow calibration methods (i.e. calibration of the printing unit alignment, calibration of the folding apparatus and/or calibration of the alignment between the printing unit and a folding unit) to be combined, simplifying the set up a print apparatus.

Figure 5:
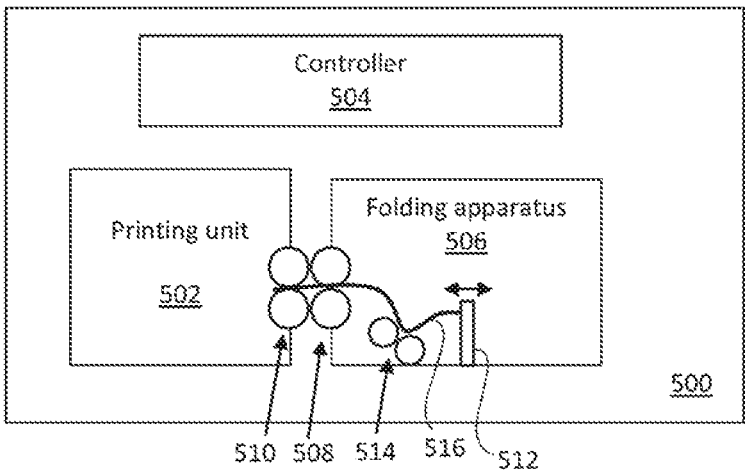
FIG. 5 is a simplified schematic of another example print apparatus.

FIG. 5 shows a print apparatus 500 comprising a printing unit 502 and a controller 504 and further comprising a folding apparatus 506. A feed input 508 into the folding apparatus 506 is associated with an output 510 of the printing unit 502. In this example, the feed input 508 and the output 510 are shown as roller pairs, but other inputs and outputs may be provided.

The folding apparatus 506 is intended to fold media sheets output by the printing unit 502 along at least one fold line. In this example, the folding apparatus 506 comprises a stopper 512 and a roller pair 514. The stopper 512 arrests the leading edge of a media sheet 516, and the continued feed of that sheet 516 by the feed input 508 causes a loop to be formed in the media sheet 516. The loop is captured by the roller pair 514, which draw in and press on the loop to form a fold. The distance between the roller pair 514 and the stopper 512 sets the location of the fold. In this example, as indicated by the arrows, the position of stopper 512 may be adjusted to vary the location of the fold, in particular, the distance of the fold from the leading edge.

This is just one example of a folding apparatus 506 and other examples may be used. In other examples, the folding apparatus 506 may comprise at least one pressing plate arrange to press on a loop of media sheet to form a fold, or some other folding mechanism. In other examples, the folding apparatus 506 may create a plurality of folds, for example, comprising a plurality of roller pairs or fold plates and/or by recirculating the media sheet 516 within the folding apparatus 506.

In this example, the controller 504 controls the folding apparatus 506 as well as the printing unit 502. In some examples, the print apparatus 600 may comprise a user input, for example an interface which may comprise a button or touchscreen interface, or may be controlled by a connected processing apparatus.

In some examples, calibrating the folding apparatus 506 may comprise adjusting the position of a stopper 512 (or any other internal mechanism which sets the location of a fold). In some examples, calibrating the folding apparatus 506 may comprise ensuring that the folding apparatus 506 and the printing unit 502 are correctly aligned.

Figure 6:
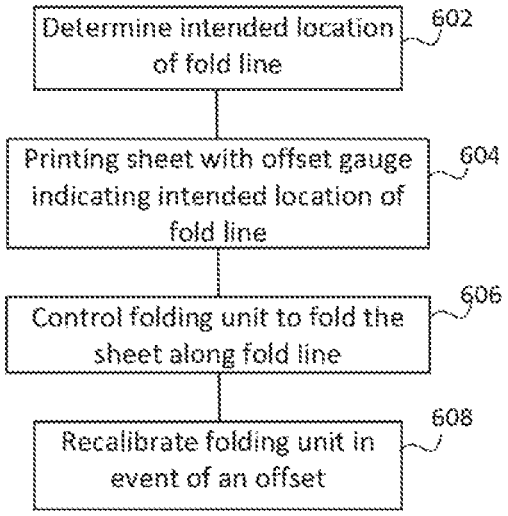
FIG. 6 is a flowchart of an example of a method of recalibrating a folding apparatus associated with a print apparatus.

In some examples, the print apparatus 500 may be a high volume print apparatus. The print apparatus 500 may be a large format print apparatus, arranged to print and fold large format plots (for example, intended to process a sheet of media larger than 29.7 cm by 42.0 cm, or A3, size). In some examples, a user may control print apparatus 100, 500 according to the method set out in FIG. 6 (which method may also be used with other apparatus).

In block 602, an intended location of at least one fold line to be formed in a sheet of print media is determined (for example from received printing data, which may be indicative of a design to be printed on a media sheet and folded, or following user input, or the like). Block 604 comprises printing a sheet of print media with an offset gauge indicating the intended location of the fold line. For example, this may comprise an indicia, such as the indicia 200 shown in FIG. 2. Block 606 comprises controlling a folding unit (for example, a folding apparatus 506) to fold the sheet of print media along a fold line. Block 608 comprises recalibrating the folding unit in the event that an offset between the intended location of the fold line and the fold line formed by the folding unit is evident.

In some examples, block 608 may comprise recalibrating the folding unit based on a user input, i.e. a user may observe a misalignment between a printed offset gauge and the actual location of a fold line and input an adjustment in light of the observed misalignment. In other examples, the offset may be identified by capturing an image of at least part of a printed offset gauge, and the recalibration may be carried out automatically.

Block 608 may comprise recalibrating the folding unit by an amount indicated by the offset indicated by the printed offset gauge.

In some examples, a method may further comprise printing a sheet of print media with a print registration mark providing an offset gauge for print registration (for example, a registration mark 402 as shown in FIG. 4). In such example, the location of the print registration marks may be determined, for example, from data characterising the shape and size of the sheet of print media.

Such a method may allow for ease of adjustment of the printing and/or folding alignment. For example, a user may prepare a print job but, prior to ordering the print job, request print of a calibration plot bearing indicia or gauges. The may be printed with the settings to be used for the print job such as the page set up, output destination, fold apparatus settings, and the like. Once is printed, such a calibration plot may bear the gauge, for example a pattern or indicia, and which, may allow an easy and accurate reading of the offset parameters. In some examples, the offsets may be read from the folded article and entered into the apparatus to perform recalibration. Such recalibration may be carried out iteratively in some examples, for example until an offset is resolved.

This therefore provides a fast and simple method for calibrating a folding apparatus. In examples where the folding apparatus is integrated with a printing unit, this provides a convenient calibration process of an end-to-end solution printing apparatus. When compared to solutions such as measuring location of the folds directly with a ruler or the like, the approach proposed herein is quicker and/or less error prone.

Where a registration mark is also printed, this provides confidence that an indicia associated with a fold line is printed in a correct location.

Figure 7:
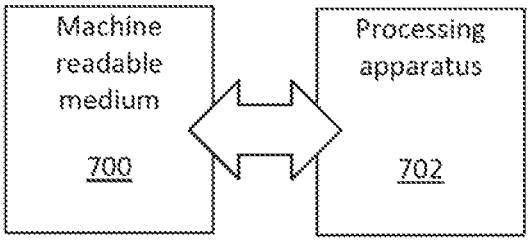
FIG. 7 is an example of a non-transitory machine readable memory associated with a processor.

FIG. 7 shows a non-transitory machine readable medium 700 and a processing apparatus 702. The machine readable medium 700 stores instructions, which, when executed by the processing apparatus 702, cause the processing apparatus 702 to determine an intended location of a fold line in a printed media sheet; and to print at least one indicia on a media sheet, the at least one indicia providing an offset gauge to indicate an offset between the intended location of the fold line and a fold line formed in the media sheet. Such an offset gauge may for example be an indicia 200 as shown in FIG. 2. The instructions may further be to cause the processing apparatus to print at least one registration mark to indicate a registration or mis-registration of the printing unit and the media sheet. Such registration marks may for example be registration marks 402 as shown in FIG. 4.

The present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to a flow chart according to an example of the present disclosure. Although the flow diagrams described above show a specific order of execution, the order of execution may differ from that which is depicted. It shall be understood that each block in the flow charts, as well as combinations of the blocks in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices (for example, the controller 104, 504) may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by block(s) in the flow charts.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited solely by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print apparatus comprising:

a printing unit; and a controller to control the printing unit to print a media sheet with at least one indicia indicating an intended location of a fold line, wherein the media sheet is to be folded along the fold line;

wherein the controller is to control the printing unit to print the at least one indicia to provide an offset gauge such that, when the media sheet is folded along a formed fold line, the indicia to provide an indication of lateral and angular offsets between the intended location of the fold line and the formed fold line; and wherein the controller is to control the printing unit to print a registration mark to indicate a registration or mis-registration of the printing unit and the media sheet, wherein the registration mark comprises a plurality of corner markings disposed at a corner of the media sheet.

2. The print apparatus according to claim 1 in which the controller is to control the printing unit to print the at least one indicia to overlie the intended location of the fold line.

3. The print apparatus according to claim 1 in which the controller is to control the printing unit to print the at least one indicia to provide an offset gauge comprising a scale.

4. The print apparatus according to claim 1 in which the controller is to determine the intended location of the fold line from data representing a design to be printed by the printing unit.

5. The print apparatus according to claim 1 wherein the plurality of corner markings of the registration mark are spaced from one another along a line extending from the corner of the media sheet.

6. The print apparatus according to claim 4 in which the controller is to control the printing unit to print the at least one registration mark so as to be at least partially outside an intended print area in an event of mis-registration between the printing unit and the media sheet.

7. The print apparatus according to claim 6 in which the controller is to control the printing unit to print the at least one registration mark which provides a registration gauge such that a portion of registration printed within the intended print area provides an indication of the degree of mis-registration between the printing unit and the media sheet.

8. The print apparatus according to claim 1 which further comprises a folding unit intended to fold the media sheet along at least one fold line.

9. A non-transitory machine readable medium comprising instructions, which, when executed by a processing apparatus, cause the processing apparatus to:

determine an intended location of the fold line in a printed media sheet;

print at least one indicia on a media sheet, the at least one indicia providing an offset gauge to indicate lateral and angular offsets between the intended location of the fold line and a fold line formed in the media sheet; and print a registration mark to indicate a registration or mis-registration of a printing unit printing the at least one registration mark and the media sheet, wherein the registration mark comprises a plurality of corner markings disposed at a corner of the media sheet.

10. A method comprising:

determining an intended location of a fold line to be formed in a sheet of print media;

printing a sheet of print media with an offset gauge indicating the intended location of the fold line and a print registration mark providing a print registration offset gauge, wherein the registration mark comprises a plurality of corner markings disposed at a corner of the media sheet;

controlling a folding unit to fold the sheet of print media along a fold line; and recalibrating the folding unit in the event that an angular offset between the intended location of the fold line and the fold line formed by the folding unit is evident.

11. The method according to claim 10 comprising recalibrating the folding unit by an amount indicated by an offset indicated by the printed offset gauge.

* * * * *